US005758521A

United States Patent [19]

Roberts

[11] Patent Number: 5,758,521

[45] Date of Patent: Jun. 2, 1998

[54] AUTOMATIC DETERGENT AND FABRIC SOFTENER DISPENSING SYSTEM

[76] Inventor: Perrion D. Roberts, 6308 Matic Rd., Huntsville, Ala. 35810

[21] Appl. No.: 799,003

[22] Filed: Feb. 7, 1997

[51] Int. Cl.[6] ..... D06F 39/02

[52] U.S. Cl. ..... 68/17 R; 68/207; 68/12.8; 222/651

[58] Field of Search ..... 68/17 R, 207, 68/12.8; 222/651

[56] References Cited

U.S. PATENT DOCUMENTS

| | | | |
|---|---|---|---|
| 3,094,247 | 6/1963 | Marchi | 68/17 R |
| 3,826,113 | 7/1974 | Boraas et al. | 68/207 |
| 3,881,328 | 5/1975 | Kleimola et al. | 68/207 |
| 4,009,598 | 3/1977 | Barnard et al. | 68/207 |
| 4,218,264 | 8/1980 | Federghi et al. | 68/207 |
| 4,932,227 | 6/1990 | Hogrefe | 68/207 |
| 5,046,336 | 9/1991 | Ferguson et al. | 68/17 R |
| 5,390,385 | 2/1995 | Belham | 68/12.18 |

FOREIGN PATENT DOCUMENTS

| | | | |
|---|---|---|---|
| 2363936 | 7/1975 | Germany | 68/17 R |
| 4015410 | 11/1991 | Germany | 68/17 R |
| 52-9983 | 1/1977 | Japan | 68/17 R |
| 61-98294 | 5/1986 | Japan | 68/17 R |
| 63-43698 | 2/1988 | Japan | 68/17 R |
| 63-318997 | 12/1988 | Japan | 68/17 R |
| 1-308594 | 12/1989 | Japan | 68/17 R |
| 3-173599 | 7/1991 | Japan | 68/12.18 |
| 812300 | 4/1959 | United Kingdom | 68/17 R |

*Primary Examiner*—Frankie L. Stinson

[57] ABSTRACT

An automatic detergent and fabric softener dispensing system for use with a washer with cold and hot water input lines which are opened upon the actuation of associated solenoidal valves. The present invention includes a pair of cylindrical tanks. The tanks each have an output conduit each connected at first end thereof to a bottom of the associated tank and a second end thereof in communication with the washer. The pair of tanks consist of a detergent tank with an associated detergent pump situated in communication with the corresponding output conduit. Such pump is adapted to effect the transmission of detergent to the washer only during the receipt of an activation signal. Associated therewith is a fabric softener tank with an associated fabric softener pump situated in communication with the corresponding output conduit. Similar to the pump of the detergent tank, the present pump is adapted to effect the transmission of fabric softener to the washer only during the receipt of an activation signal. Control circuitry is provided for transmitting an activation signal to the detergent pump upon the first actuation of the solenoidal valves and further for transmitting an activation signal to thee fabric softener pump upon subsequent actuation of the solenoidal valves. Finally, control knobs are included for selecting the duration of the activation signal which, in turn, determines the amount of detergent and fabric softener is dispensed.

2 Claims, 3 Drawing Sheets

AUTOMATIC DETERGENT AND FABRIC SOFTENER DISPENSING SYSTEM

BACKGROUND OF THE INVENTION

1. Field of the Invention

The present invention relates to an automatic detergent and fabric softener dispensing system and more particularly pertains to allowing a user to independently control the amount of detergent and fabric softener which is automatically delivered to a washer at appropriate times during a wash cycle.

2. Description of the Prior Art

The use of fabric softener and detergent dispensers is known in the prior art. More specifically, fabric softener and detergent dispensers heretofore devised and utilized for the purpose of allowing the dispensing of fabric softeners and detergent within a washer are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,858,449 to Lehn; U.S. Pat. No. 5,390,385to Beldham; U.S. Pat. No. 4,889,644 to Amberg at al.; U.S. Pat. No. 4,776,455 to Anderson et al; U.S. Pat. No. 5,444,730 to Renders et al.; and U.S. Pat. Des. No. 345,636 to Noprano.

In this respect, the automatic detergent and fabric softener dispensing system according to the present invention substantially departs from the conventional concepts and designs of the prior art, and in so doing provides an apparatus primarily developed for the purpose of allowing a user to independently control the amount of detergent and fabric softener which is automatically delivered to a washer at appropriate times during a wash cycle.

Therefore, it can be appreciated that there exists a continuing need for a new and improved automatic detergent and fabric softener dispensing system which can be used for allowing a user to independently control the amount of detergent and fabric softener which is automatically delivered to a washer at appropriate time during the wash cycle. In this regard, the present invention substantially fulfills this need.

SUMMARY OF THE INVENTION

In view of the foregoing disadvantages inherent in the known types of fabric softener and detergent dispensers now present in the prior art, the present invention provides an improved automatic detergent and fabric softener dispensing system. As such, the general purpose of the present invention, which will be described subsequently in greater detail, is to provide a new and improved automatic detergent and fabric softener dispensing system which has all the advantages of the prior art and none of the disadvantages.

To attain this, the present invention essentially comprises a washer having an unillustrated hot water input conduit with an associated hot water solenoidal valve adapted to open upon the receipt of a hot water signal for allowing hot water to be supplied to the washer. The washer further has a cold water input conduit with an associated cold water solenoidal valve adapted to open upon the receipt of a cold water signal for allowing cold water to be supplied to the washer. In the first embodiment, a housing is included with a rectangular configuration, as shown in FIGS. 1–3. Such housing has a front face, a rear face, a top face, a bottom face, and a pair of side faces defining an interior space. The housing further includes a pair of vertically oriented transparent strips for allowing a user to view the interior space. As can be seen in FIG. 3, a pair of transparent cylindrical tanks are situated within the housing adjacent opposite side faces thereof. Each tank has a top opening extending through the top face of the housing with an associated cap for allowing the selective insertion of washing material therein. By this structure, a user may view the amount of material therein through the transparent strips. See FIG. 4. Each of the tanks further include a pair of output conduits which are each connected at first end thereof to a bottom of an associated tank. Such output conduits are each connected at a second end thereof in communication with the washer. It should be noted that the pair of tanks consist of a detergent tank and a fabric softener tank. The detergent tank has an associated detergent pump situated within the housing in communication with the corresponding output conduit. Such pump is adapted to effect the transmission of detergent to the washer only during the receipt of an activation signal. Similarly, the fabric softener tank has an associated fabric softener pump also situated within the housing in communication with the corresponding output conduit. In use, the present pump is adapted to effect the transmission of fabric softener to the washer only during the receipt of an activation signal. Finally, control circuitry is situated within the housing and connected between the solenoidal valves and the detergent pump and the fabric softener pump. In use, the control circuitry is adapted for transmitting an activation signal to the detergent pump upon the first receipt of a water signal by one of the solenoid valves and further transmitting an activation signal to the fabric softener pump upon the second subsequent receipt of a water signal by one of the solenoidal valves. With reference to FIG. 5, it can be seen that the control circuitry includes pulse means connected to the solenoidal valves for delivering a pulse of a predetermined duration upon the receipt of a water signal by one of the solenoidal valves. Connected to the pulse means is control selection means for transmitting an activation signal to the detergent pump upon the first receipt of the pulse and further transmitting an activation signal to the fabric softener pump upon the second subsequent receipt of the pulse. Lastly, the control circuitry includes quantity control means connected between the control selection means and the solenoidal valves of the pumps. In use, the quantity control means is adapted for allowing a user to selectively determine the duration of the activation signal, thereby allowing the user to independently determine the quantity of the detergent and the fabric softener which is delivered to the washer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic detergent and fabric softener dispensing system which has all the advantages of the prior art fabric softener and detergent dispensers and none of the disadvantages.

It is another object of the present invention to provide a new and improved automatic detergent and fabric softener dispensing system which may be easily and efficiently manufactured and marketed.

It is a further object of the present invention to provide a new and improved automatic detergent and fabric softener dispensing system which is of a durable and reliable construction.

An even further object of the present invention is to provide a new and improved automatic detergent and fabric softener dispensing system which is susceptible of a low cost of manufacture with regard to both materials and labor, and which accordingly is then susceptible of low prices of sale to the consuming public, thereby making such automatic detergent and fabric softener dispensing system economically available to the buying public.

Still yet another object of the present invention is to provide a new and improved automatic detergent and fabric softener dispensing system which provides in the apparatuses and methods of the prior art some of the advantages thereof, while simultaneously overcoming some of the disadvantages normally associated therewith.

Still another object of the present invention is to allow a user to independently control the amount of detergent and fabric softener which is automatically delivered to a washer at appropriate times during a wash cycle.

Lastly, it is an object of the present invention to provide a new and improved automatic detergent and fabric softener dispensing system for use with a washer with cold and hot water input lines which are opened upon the actuation of associated solenoidal valves. The present invention includes a pair of cylindrical tanks. The tanks each have an output conduit each connected at first end thereof to a bottom of the associated tank and a second end thereof in communication with the washer. The pair of tanks consist of a detergent tank with an associated detergent pump situated in communication with the corresponding output conduit. Such pump is adapted to effect the transmission of detergent to the washer only during the receipt of an activation signal. Associated therewith is a fabric softener tank with an associated fabric softener pump situated in communication with the corresponding output conduit. Similar to the pump of the detergent tank, the present pump is adapted to effect the transmission of fabric softener to the washer only during the receipt of an activation signal. Control circuitry is connected between the solenoidal valves and the detergent pump and the fabric softener pump for transmitting an activation signal to the detergent pump upon the first actuation of the solenoidal valves and further for transmitting an activation signal to thee fabric softener pump upon subsequent actuation of the solenoidal valves. Finally, control knobs are included for selecting the duration of the activation signal which, in turn, determines the amount of detergent and fabric softener is dispensed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
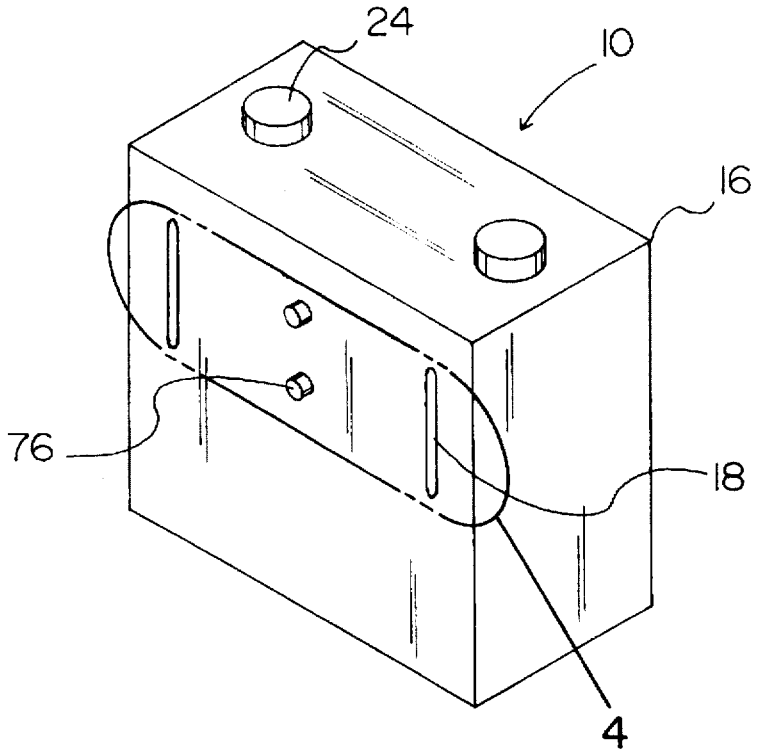
FIG. 1 is a perspective illustration of the preferred embodiment of the automatic detergent and fabric softener dispensing system constructed in accordance with the principles of the present invention.

With reference now to the drawings, and in particular to FIG. 1 thereof, a new and improved automatic detergent and fabric softener dispensing system embodying the principles and concepts of the present invention and generally designated by the reference numeral 10 will be described.

The present invention, the new and improved automatic detergent and fabric softener dispensing system, is comprised of a plurality of components. Such components in their broadest context include a washer, a pair of tanks with associated pumps, and control circuitry. Such components are individually configured and correlated with respect to each other so as to attain the desired objective.

More specifically, it will be noted that the system 10 of the present invention includes a washer having an unillustrated hot water input conduit with an associated hot water solenoidal valve 12 adapted to open upon the receipt of a hot water signal for allowing hot water to be supplied to the washer. For allowing cold water to be supplied to the washer, the washer further has a cold water input conduit with an associated cold water solenoidal valve 14 adapted to open upon the receipt of a cold water signal.

Figure 2:
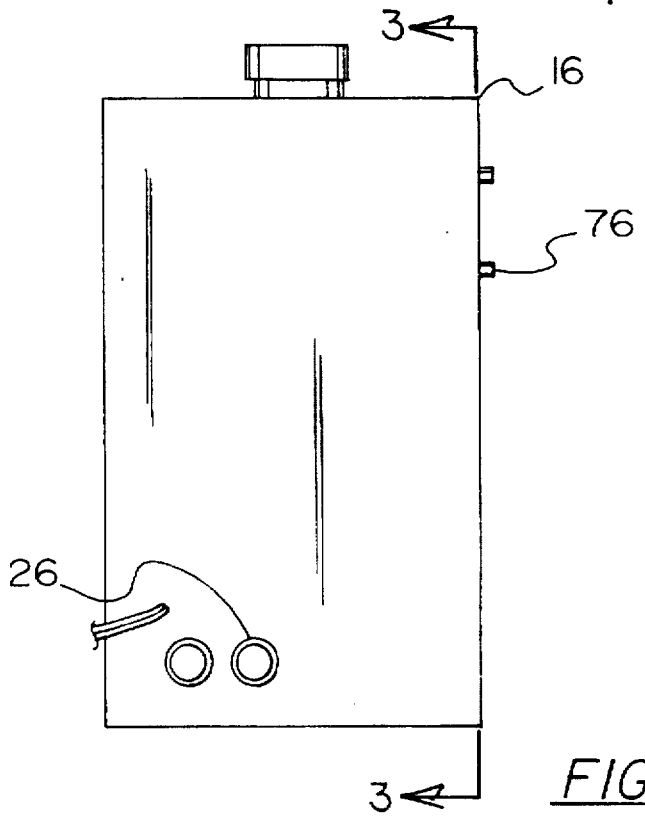
FIG. 2 is a side view of the present invention.
Figure 3:
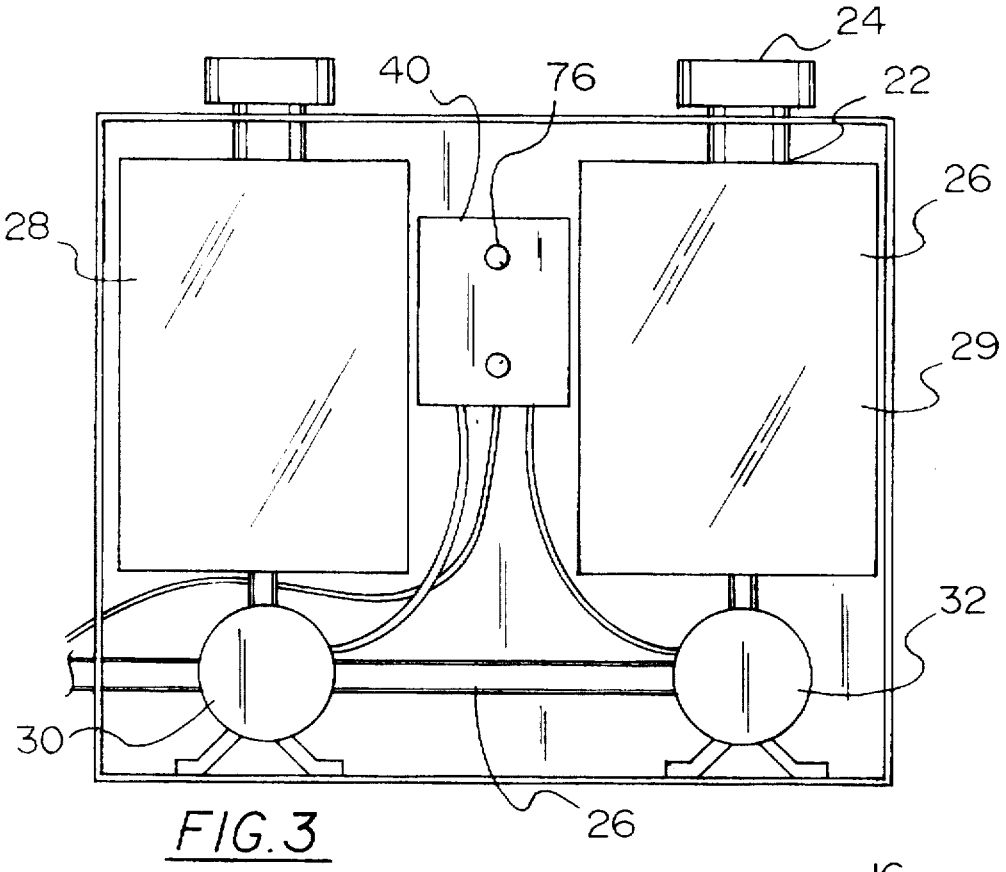
FIG. 3 is a cross-sectional view of the present invention taken along lines 3—3 shown in FIG. 2.

In the first embodiment, a housing 16 is included with a rectangular configuration, as shown in FIGS. 1–3. Such housing has a front face, a rear face, a top face, a bottom face, and a pair of side faces defining an interior space. The housing further includes a pair of vertically oriented transparent strips 18 for allowing a user to view the interior space.

Figure 4:
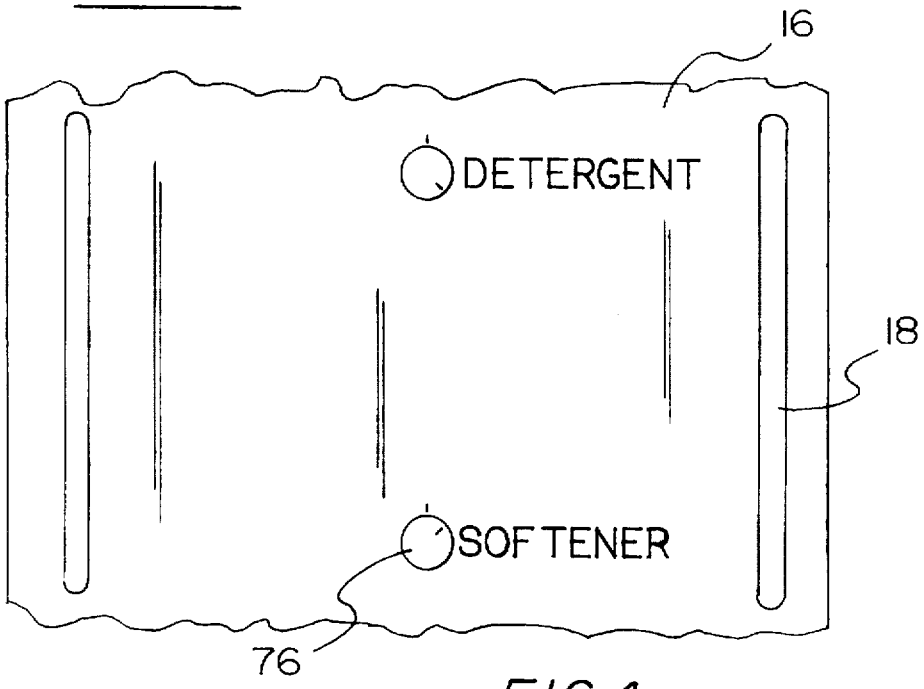
FIG. 4 is a cut away view of the front face of the housing of the present invention.

As can be seen in FIG. 3, a pair of transparent cylindrical tanks 20 are situated within the housing adjacent opposite side faces thereof. Each tank has a top opening 22 extending through the top face of the housing with an associated cap 24 for allowing the selective insertion of washing material therein. By this structure, a user may view the amount of material therein through the transparent strips. See FIG. 4.

Each of the tanks further include a pair of output conduits 26 which are each connected at first end thereof to a bottom of an associated tank. Such output conduits are each connected at a second end thereof in communication with the washer. It should be not ed that the pair of tanks consist of a detergent tank 28 and a fabric softener tank 29. The detergent tank has an associated detergent pump 30 situated within the housing in communication with the corresponding output conduit. Such pump is adapted to effect the transmission of detergent to the washer only during the receipt of an activation signal. Similarly, the fabric softener tank has an associated fabric softener pump 32 also situated within the housing in communication with the corresponding output conduit. In use, the present pump is adapted to effect the transmission of fabric softener to the washer only during the receipt of an activation signal.

Finally, control circuitry 40 is situated within the housing and connected between the solenoidal valves and the detergent pump and the fabric softener pump. During each washing, the control circuitry is adapted for transmitting an activation signal to the detergent pump upon the first receipt of a water signal by one of the solenoid valves and further transmitting an activation signal to the fabric softener pump upon the second subsequent receipt of a water signal by one of the solenoidal valves.

Figure 5:
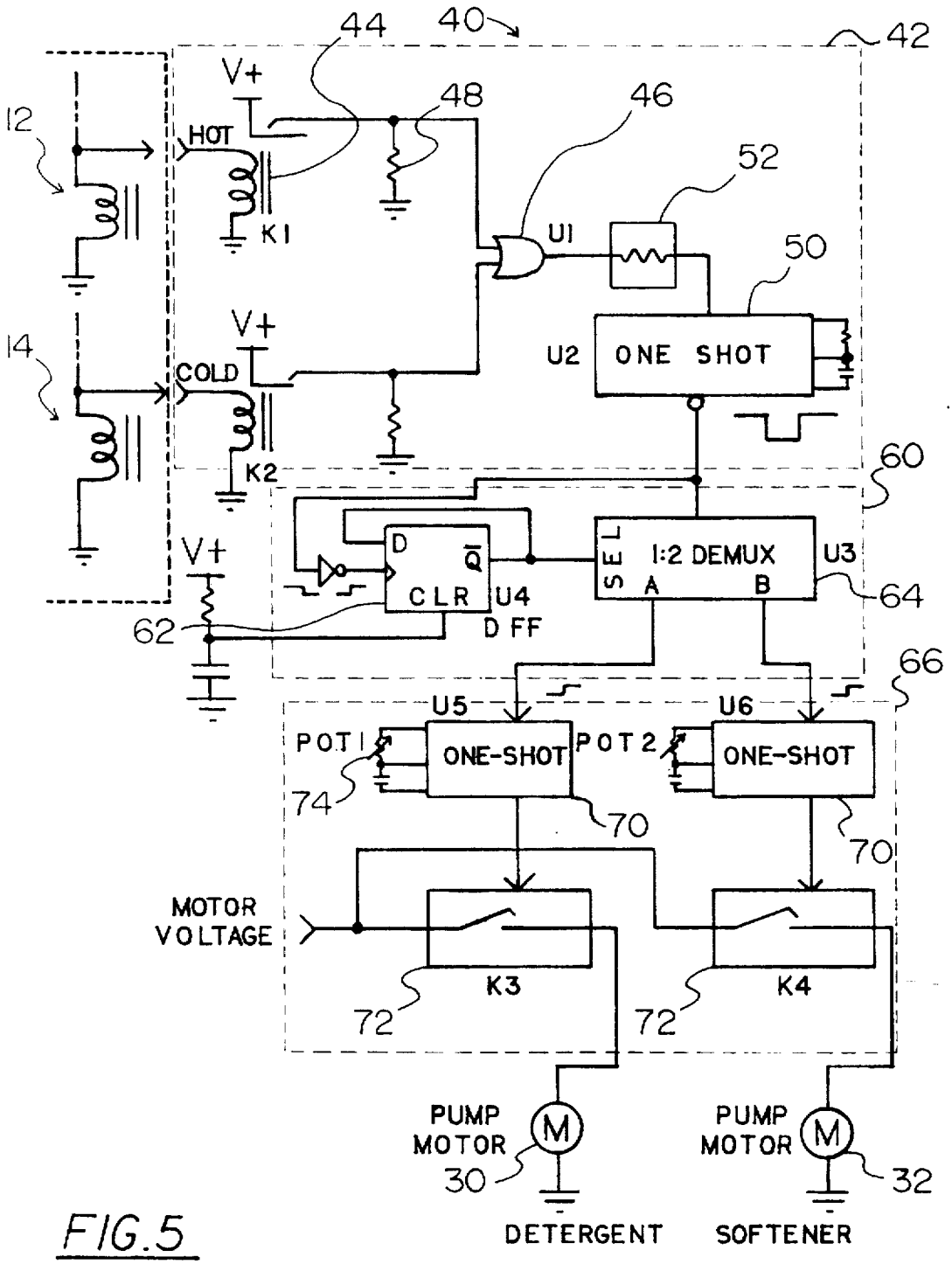
FIG. 5 is a schematic of the circuitry employed in the present invention.

With reference to FIG. 5, it can be seen that the control circuitry includes pulse means 42 connected to the solenoidal valves for delivering a pulse of a predetermined duration upon the receipt of a water signal by one of the solenoidal valves. Specifically, the pulse means includes a pair of relays 44 each connected to a respective power line which powers the solenoidal valves such that the relays create a pulse upon the receipt of a water signal by the associated solenoidal valve. The pulse means further includes an OR gate 46 with inputs each connected to one of the relays, whereby a pulse is generated at an output of the OR gate upon the receipt of a pulse from either of the relays. It should be noted that a pair of resistors 48 may be utilized to ensure that a proper voltage is delivered to the inputs of the OR gate. Further provided as a component of the pulse means is a primary one-shot multivibrator 50 with an input connected to the output of the OR gate. By this structure, the primary multivibrator provides a pulse of a predetermined duration upon the receipt of a pulse by the OR gate. In use, the primary multivibrator delivers a pulse of predetermined length of time independent of the duration of the pulse received at its input. Yet another component of the pulse means is delay circuitry 52 connected between the OR gate and primary multivibrator. Such circuitry functions to delay the transmission of the pulse to the primary multivibrator for 90 seconds upon the receipt thereof from the OR gate. As will become apparent later, the delay circuitry functions to ensure that the washer has received the proper amount of water before detergent or fabric softener is added, thereby protecting the clothes.

Connected to the pulse means is control selection means 60 for transmitting an activation signal to the detergent pump upon the first receipt of the pulse and further transmitting an activation signal to the fabric softener pump upon the second subsequent receipt of the pulse. As shown in FIG. 5, the control selection means includes a D-flip flop 62 with an input thereof connected to the output of the primary multivibrator. The D-flip flop is configured to transmit an alternating high pulse and low pulse upon the subsequent receipt of pulses at the input thereof. Also included as a component of the control selection means is a 1×2 multiplexer 64 with an input thereof also connected to the output of the primary multivibrator. A selection input of the multiplexer is connected to the output of the D-flip flop. As shown in FIG. 5, the multiplexer has two outputs. By its inherent design, upon a first receipt of a pulse from the primary multivibrator, the output of the D-flip flop is such that the first output of the multiplexer is high while a second output is low, wherein the high pulse constitutes the activation signal. As is now apparent, the duration of the pulse delivered by the primary multiplexer must be sufficient to afford proper operation of the control selection means.

Lastly, the control circuitry includes quantity control means 66 connected between the control selection means and the solenoidal valves of the pumps. In use, the quantity control means is adapted for allowing a user to selectively determine the duration of the activation signal, thereby allowing the user to independently determine the quantity of the detergent and the fabric softener which is delivered to the washer. Specifically, the quantity control means includes a pair of secondary one-shot multivibrators 70 which are each connected at an input thereof to an associated output of the multiplexer, whereby upon the receipt of an activation signal, the secondary multivibrators are adapted to transmit the same for a predetermined amount of time. A voltage controlled switch 72 such as a relay, FET or the like is connected between the output of the secondary outputs and the corresponding pump to actuate the pumps at the proper voltage during the receipt of the activation signal supplied by the corresponding secondary multivibrator. For controlling the duration of the activation signal leaving the secondary multivibrators, each secondary multivibrator is equipped with a potentiometer 74 with an associated knob 76 situated on the front face of the housing. Such potentiometers are incorporated in an RC network which dictates the duration of the pulse which leaves the output of the associated secondary multivibrator.

In an alternate embodiment, the housing is not included and the tanks, pumps, and control circuitry are incorporated in the washer during use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved automatic detergent and fabric softener dispensing system comprising, in combination:

a washer having a hot water input conduit with an associated hot water solenoidal valve adapted to open upon the receipt of a hot water signal for allowing hot water to be supplied to the washer, the washer further having a cold water input conduit with an associated cold water solenoidal valve adapted to open upon the receipt of a cold water signal for allowing cold water to be supplied to the washer;

a housing with a rectangular configuration with a front face, a rear face, a top face, a bottom face, and a pair of side faces defining an interior space, the housing having a pair of vertically oriented transparent strips for allowing a user to view the interior space;

a pair of transparent cylindrical tanks situated within the housing adjacent opposite side faces thereof, each tank having a top opening extending through the top face of the housing with an associated cap for allowing the selective insertion of washing material therein whereby a user may view the amount of material therein through the transparent strips, the tanks each further including an output conduit each connected at first end thereof to a bottom of an associated tank and at second end thereof in communication with the washer, the pair of tanks comprising a detergent tank with an associated detergent pump situated within the housing in communication with the corresponding output conduit and adapted to effect the transmission of detergent to the washer only during the receipt of an activation signal and a fabric softener tank with an associated fabric softener pump situated within the housing in communication with the corresponding output conduit and adapted to effect the transmission of fabric softener to the washer only during the receipt of an activation signal; and control circuitry situated within the housing and connected between the solenoidal valves and the detergent pump and the fabric softener pump for transmitting an activation signal to the detergent pump upon the first receipt of a water signal by one of the solenoid valves and further transmitting an activation signal to the fabric softener pump upon the second subsequent receipt of a water signal by one of the solenoidal valves, the control circuitry comprising:

pulse means connected to the solenoidal valves for delivering a pulse of a predetermined duration upon the receipt of a water signal by one of the solenoidal valves, the pulse means further including delay means for delaying the transmission of the pulse, control selection means connected to the pulse means for transmitting an activation signal to the detergent pump upon the first receipt of the pulse and further transmitting an activation signal to the fabric softener pump upon the second subsequent receipt of the pulse, and quantity control means connected between the control selection means and the solenoidal valves of the pumps for allowing a user to selectively determine the duration of the activation signal, thereby allowing the user to independently determine the quantity of the detergent and the fabric softener which is delivered to the washer.

2. A automatic detergent and fabric softener dispensing system comprising:

a washer having a hot water input conduit with an associated hot water solenoidal valve adapted to open upon the receipt of a hot water signal for allowing hot water to be supplied to the washer, the washer further having a cold water input conduit with an associated cold water solenoidal valve adapted to open upon the receipt of a cold water signal for allowing cold water to be supplied to the washer;

a housing with a rectangular configuration with a front face, a rear face, a top face, a bottom face, and a pair of side faces defining an interior space, the housing having a pair of vertically oriented transparent strips for allowing a user to view the interior space;

a pair of transparent cylindrical tanks situated within the housing adjacent opposite side faces thereof, each tank having a top opening extending through the top face of the housing with an associated cap for allowing the selective insertion of washing material therein whereby a user may view the amount of material therein through the transparent strips, the tanks each further including an output conduit each connected at first end thereof to a bottom of an associated tank and at second end thereof in communication with the washer, the pair of tanks comprising a detergent tank with an associated detergent pump situated within the housing in communication with the corresponding output conduit and adapted to effect the transmission of detergent to the washer only during the receipt of an activation signal and a fabric softener tank with an associated fabric softener pump situated within the housing in communication with the corresponding output conduit and adapted to effect the transmission of fabric softener to the washer only during the receipt of an activation signal; and control circuitry situated within the housing and connected between the solenoidal valves and the detergent pump and the fabric softener pump for transmitting an activation signal to the detergent pump upon the first receipt of a water signal by one of the solenoid valves and further transmitting an activation signal to the fabric softener pump upon the second subsequent receipt of a water signal by one of the solenoidal valves, the control circuitry comprising:

pulse means connected to the solenoidal valves for delivering a pulse of a predetermined duration upon the receipt of a water signal by one of the solenoidal valves, wherein the pulse means includes a pair of relays, an OR gate with inputs connected to the relay, and a one-shot multivibrator with an input connected to an output of the OR gate, the pulse means further including delay means for delaying the transmission of the pulse with the delay means connected between the OR gate and the one-shot multivibrator, control selection means connected to the pulse means for transmitting an activation signal to the detergent pump upon the first receipt of the pulse and further transmitting an activation signal to the fabric softener pump upon the second subsequent receipt of the pulse, wherein the control selection means includes a D-flip flop with an input connected to an output of the one-shot multivibrator and a multiplexer connected to an output of the D-flip flop, and quantity control means connected between the control selection means and the solenoidal valves of the pumps for allowing a user to selectively determine the duration of the activation signal, thereby allowing the user to independently determine the quantity of the detergent and the fabric softener which is delivered to the washer, wherein the quality control means includes a second one-shot multivibrator with an associated potentiometer.

* * * * *